US005833048A

United States Patent [19]

Dilly

[11] Patent Number: 5,833,048

[45] Date of Patent: Nov. 10, 1998

[54] ROCKER SWITCH ESPECIALLY FOR VEHICLES

[75] Inventor: Günter Dilly, Münster - Sarmsheim, Germany

[73] Assignee: Eaton Corporation, Cleveland, Ohio

[21] Appl. No.: 971,236

[22] Filed: Nov. 15, 1997

Related U.S. Application Data

[63] Continuation of Ser. No. 699,180, Aug. 19, 1996, abandoned, which is a continuation of Ser. No. 384,901, Feb. 7, 1995, abandoned.

[51] Int. Cl.[6] ..... H01H 23/20; H01H 23/24

[52] U.S. Cl. ..... 200/446; 200/315; 200/339

[58] Field of Search ..... 200/1 R, 1 V, 200/1 B, 5 R, 6 B, 6 BB, 408, 409, 443, 453, 459–461, 315, 316, 302.3, 339

[56] References Cited

U.S. PATENT DOCUMENTS

| | | | |
|---|---|---|---|
| 2,370,479 | 2/1945 | Meyer | 200/409 |
| 2,750,802 | 6/1956 | Pashby | 200/409 |
| 2,966,559 | 12/1960 | Meyer | 200/6 BB |
| 3,562,468 | 2/1971 | Stefani | 200/295 |
| 3,582,584 | 6/1971 | Best | 200/51.16 X |
| 3,670,121 | 6/1972 | Howe | 200/446 |
| 4,191,873 | 3/1980 | Woodard | 200/315 X |
| 4,268,734 | 5/1981 | Sorenson | 200/315 |
| 4,652,706 | 3/1987 | Rao et al. | 200/1 R X |
| 4,967,046 | 10/1990 | Priesemuth | 200/339 |
| 5,017,747 | 5/1991 | Nagahara | 200/453 |
| 5,036,168 | 7/1991 | Kikuchi et al. | 200/5 R |
| 5,149,924 | 9/1992 | Priesemuth | 200/5 R |
| 5,350,889 | 9/1994 | Lauritsen | 200/1 B |

FOREIGN PATENT DOCUMENTS

| | | | |
|---|---|---|---|
| 2748839 | 5/1979 | Germany | H01H 5/04 |

*Primary Examiner*—J. R. Scott
*Attorney, Agent, or Firm*—Roger A. Johnston

[57] ABSTRACT

Rocker switch, especially for vehicles, with a spring-loaded rocker lever serving as actuator enclosed in a housing. In the housing at least one switch unit (14) strikes connection contacts (9, 17). In order to achieve a rocker switch which has a small number of individual parts and a narrow switch angle, switch unit (14) is designed as a one arm swing lever (15) which activates the connection contact associated with it (17) via a snap contact (16).

3 Claims, 4 Drawing Sheets

ROCKER SWITCH ESPECIALLY FOR VEHICLES

This application is a continuation of application Ser. No. 08/699,180, filed Aug. 19, 1996, now abandoned, which is a Continuation of Ser. No. 08/384,901, filed Feb. 7, 1995, now abandoned.

BACKGROUND OF THE INVENTION

The invention relates to a rocker switch especially for vehicles with a spring-loaded rocker lever serving as an actuator enclosed in a housing and at least one switch unit striking connection contacts.

A similar rocker switch is known from DE 27 48 839 C3 in which the switch unit has linear travel and connection contacts designed for making sliding contact. In order to ensure reliable contact, comparatively larger switch travel is required which necessitates that the actuator of the rocker switch have a wide angle of movement and a long switch arm.

SUMMARY OF THE INVENTION

The aim of the invention is to reduce the switch angle of a rocker switch of the type described above and to ensure sufficiently reliable contact.

This aim is achieved according to the invention by having the switch unit designed as a one arm swing lever which activates the associated connection contact via a snap contact.

To reduce the number of individual parts further and the manufacturing operations associated with it, the switch unit is attached to a rigid switch part through a foil hinge.

In order to provide a rocker switch which can be operated on either side of its actuator, preferably each actuator has two switch units aligned parallel in opposite directions to each other inside the housing; and, the foil hinge of a switch unit is located on the opposite end of the rigid switch part. This design has the advantage that the rocker switch according to the invention can be used as a window or mirror control switch especially for vehicles since this design allows an adjusting motor to run in either direction.

As a further development of the invention the switch unit has a U-shaped profile, the foil hinge is molded onto the middle section of the U-shaped profile. A switch hump aligned in the working direction of the actuator is attached to the end of the switch unit opposite the foil hinge. The middle section of the U-shaped profile of the switch unit has a release from the direction of the switch hump and a space is provided in the middle section near the foil hinge. This is advantageous in so far as the switch unit has very great rigidity as a result of which, even in the event of temperature stress, the contact point of the rocker switch cannot vary. The U-shaped profile provides a switch unit that is both small in volume and also low in weight as a result of which the return of the switch unit to its neutral position is ensured and the attachment of the switch unit through the foil hinge is guaranteed. The space in the middle section of the switch unit allows a light source to be placed underneath the switch unit resulting in a compact design.

According to a further advantageous extension of the invention, contact elements with connection contacts are held in the rigid switch part. U-shaped contact spring holders are bent on the contact elements and a notch is punched in each shank of the contact spring holder to hold a snap contact. Because the contact spring holder is bent on the contact elements, the contact elements can be produced as embossed grids which can be inserted as one piece as a result of which the cost of assembly is appreciably reduced. Punching of the notch in the contact spring holder allows precise insertion of the snap contacts without additional adjustment.

With further development of the object of the invention, a snap contact with a frame having lugs, which are connected to a contact point containing a contact rivet opposite the frame, is inserted in the notches of the contact spring holder. An insertion opening is limited outwards by the lugs between the frame and the contact point; and, a contact spring stretches from the contact point in the direction of the frame. The contact spring holder fits into the insertion opening whereby the inner side of the frame is inserted into a notch of the contact spring holder and the free end of the contact spring into the opposite notch of the contact spring holder, so that if the actuator is not operated, the snap contact reaches the upper rest position nearer the actuator. The snap contact has a rigid construction due to its closed form. The contact spring is made as one piece with the snap contact; and, due to the snap contact being inserted in the notches of the contact spring holder described above, achieves a more certain monostable position.

In order to obtain the same upper position for all snap contacts the upper rest position is effectively provided by a rail which is held in towers by means of a solid connection; and, the height is ensured by spacers on the rigid switch part and the rail has a connection contact. As a result of the towers and the spacer, the rail has a pre-determined position after insertion and further adjustment is not necessary.

In order to achieve compact design, a small number of parts and few additional assembly operations, the rigid switch part consists of a base and a wall, on which supports are molded, which fix contact elements to the base; and, the wall has cheeks to hold the bearing for the actuator and base and wall are joined with a clip connection.

As a result of the return force of the snap contact the actuator is brought back to its neutral position. To assist return, support bearings with a spring-loaded rod inserted in them are preferably held in the wall of the rigid switch part.

According to a further embodiment or version of the invention bearing pins are provided on the actuator which click into the bearings situated on the wall held by the cheeks; and, pressure plates are molded on the inner side of the actuator which work in conjunction with the switch unit.

In this version, no additional parts are necessary to ensure its function and assembly.

The adjustment of a part to be adjusted can be controlled by a rocker switch with an actuator. According to a further advantageous version of the invention, several rocker switches can be connected to one switch block. In this arrangement the embossed grid is designed so that it can be used for the entire switch block.

BRIEF DESCRIPTION OF THE DRAWINGS

The concept behind the invention is explained in detail in the following description by means of a practical example. It shows.

DETAILED DESCRIPTION

Figure 1:
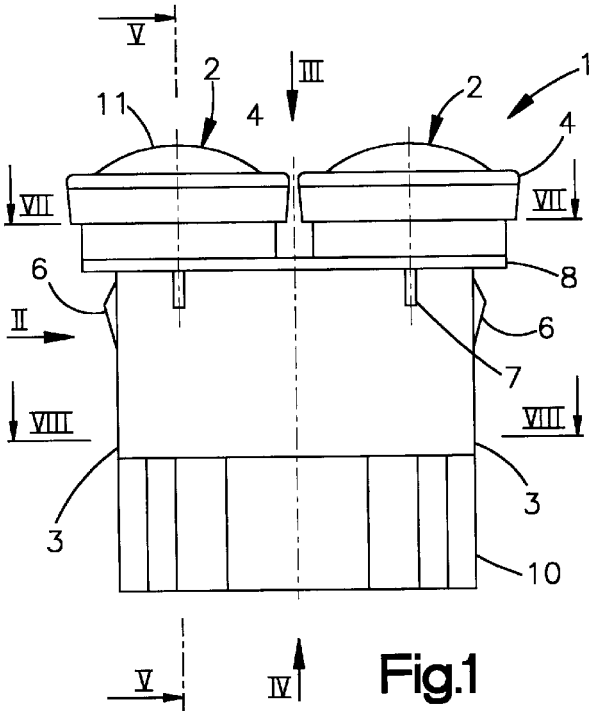
FIG. 1 a rocker switch, connected to a switch block with two actuators.
Figure 2:
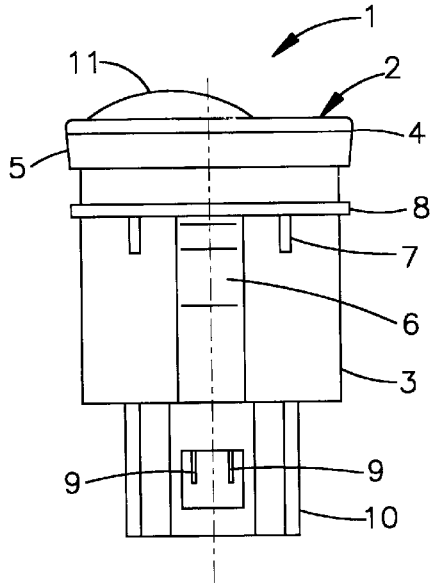
FIG. 2 a side view of the rocker switch in accordance with FIG. 1 in the direction of arrow II.
Figure 3:
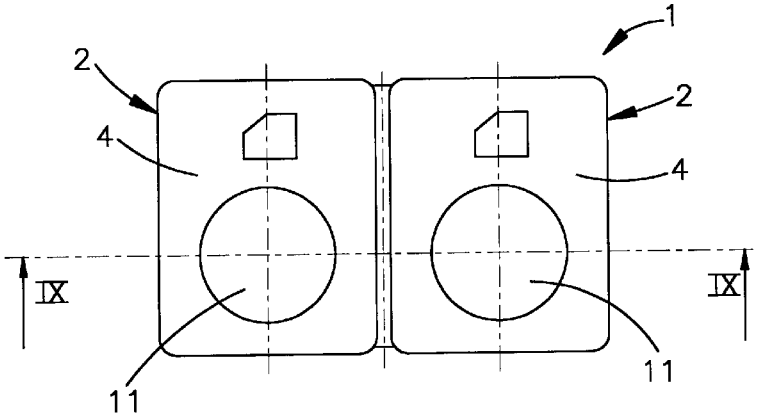
FIG. 3 the view from above of the rocker switch block in accordance with FIG. 1 in the direction of arrow III.
Figure 4:
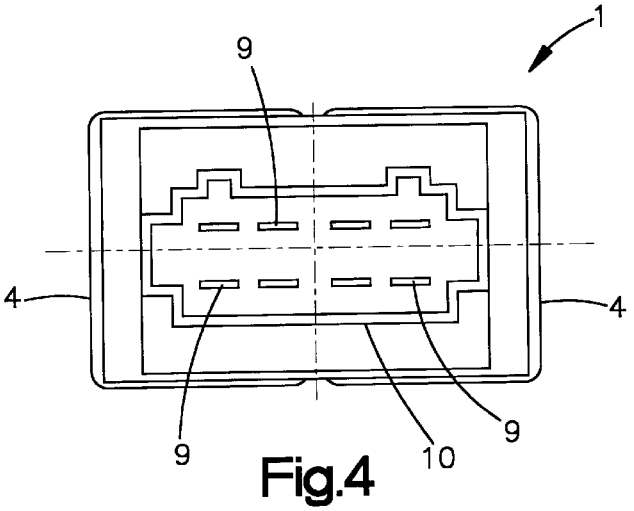
FIG. 4 the view from below of the rocker switch block in accordance with FIG. 1 in the direction of arrow IV.

FIGS. 1 to 4 show a switch block 1 which is composed in each case of a rocker switch 2. Housing 3 of each rocker switch 2 is rectangular in cross-section; and, in the case of switchblock 1 is made as one piece. Actuator 4 is located on the top which fits over housing 3 with a collar 5. On the outer wall of housing 3 securing springs 6 and guide plates 7 click into switchblock 1 in a panel (not illustrated) whereby the edge of the panel fits between surrounding flange 8 and notch spring 6. On the lower side of switch block 1 connector plugs 9 are combined in a plug collar 10. Actuator 4 has a curved bulge on its top; and, operating symbols 12 are shown in front of a transparent window 13.

Figure 5:
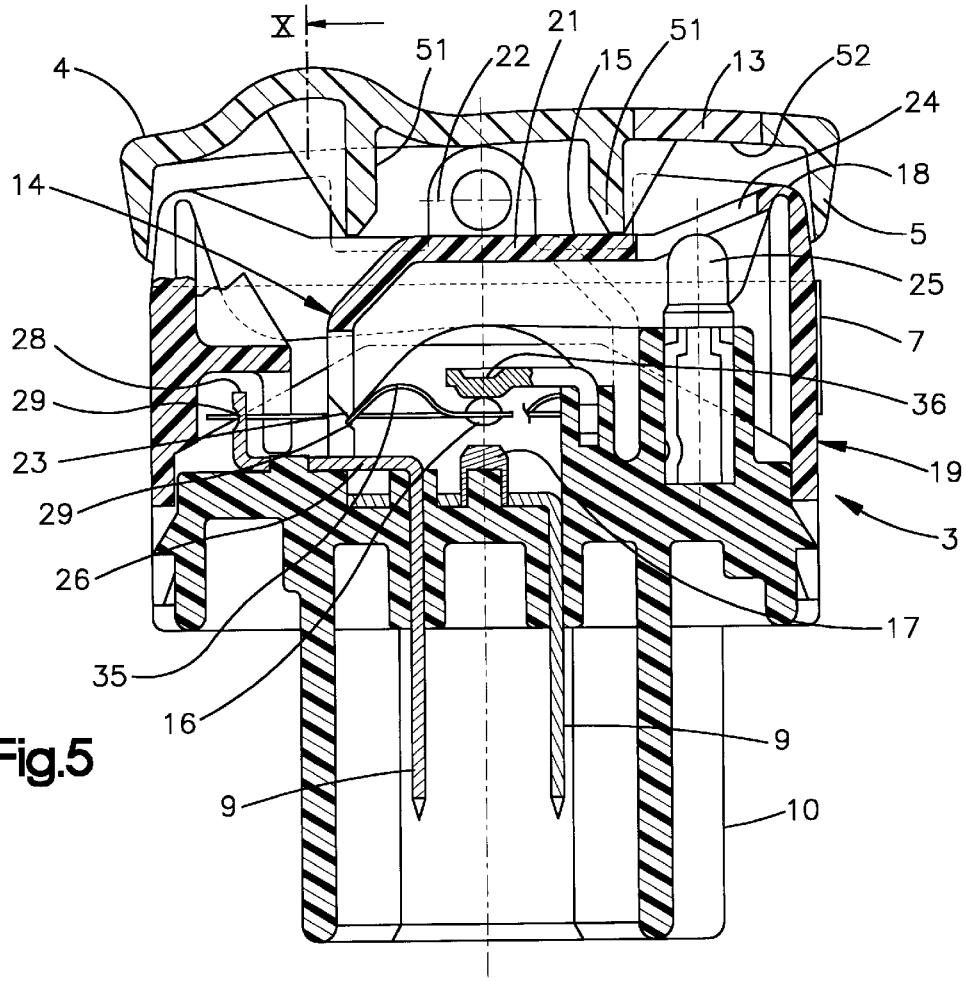
FIG. 5 a cross-section through a rocker switch in accordance with FIG. 1 along the V—V line in the non-operated condition.

Referring to FIG. 5, switch unit 14 is designed as a swing lever 15 which activates the associated connection contact 17 via a snap contact 16. Switch unit 14 is attached through a foil or integrally formed hinge 18 to the rigid switch part 19 (whereby rigid switch part 19 is the same) which forms a part of housing 3. In housing 3, each actuator 4 has two switch units aligned in parallel but opposite directions to each other. Each switch unit 14 is attached through its foil hinge 18 to the opposite side of rigid switch part 19.

Switch unit 14 has preferably a U-shaped profile 20 and foil hinge 18 is molded onto middle section 21 of U-shaped profile 20. Foil hinge 18 is located on the upper edge of rigid switch part 19. The main direction of switch unit 14 is parallel with neutral position 22 of actuator 4, on the end opposite foil hinge 18 of switch unit 14, the switch unit has a switch hump 23 aligned in the working direction of actuator 4. Switch unit 14 has a release 24 on switch hump 23 in the area of middle section 21. Also, in middle section 21 of switch unit 14 in the area of foil hinge 18, a space is left in which a light element 25 is inserted to illuminate window 13 with function symbol 12 of actuator 4 in front of it.

Figure 6:
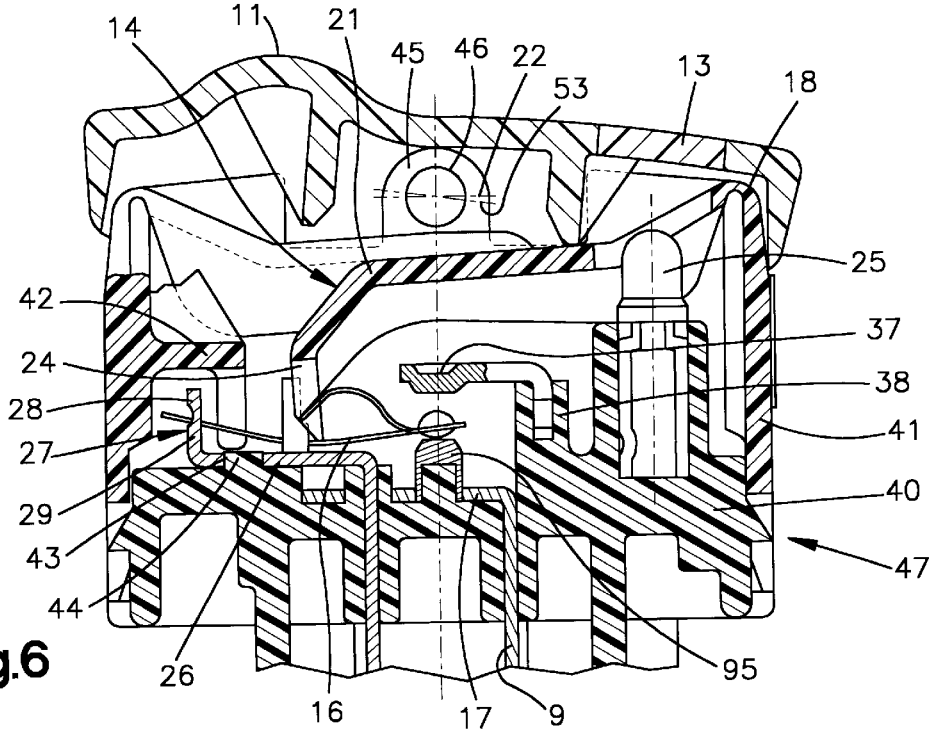
FIG. 6 the rocker switch in accordance with FIG. 5 in the operated condition.

Referring to FIG. 6, contact elements 26 with connecting contacts 9 are secured in rigid switch part 19. U-shaped contact spring holders 27 are bent on contact elements 26. A notch 29 is punched in each shank 28 of contact spring holder 27 for insertion of snap contact 16.

Figure 7:
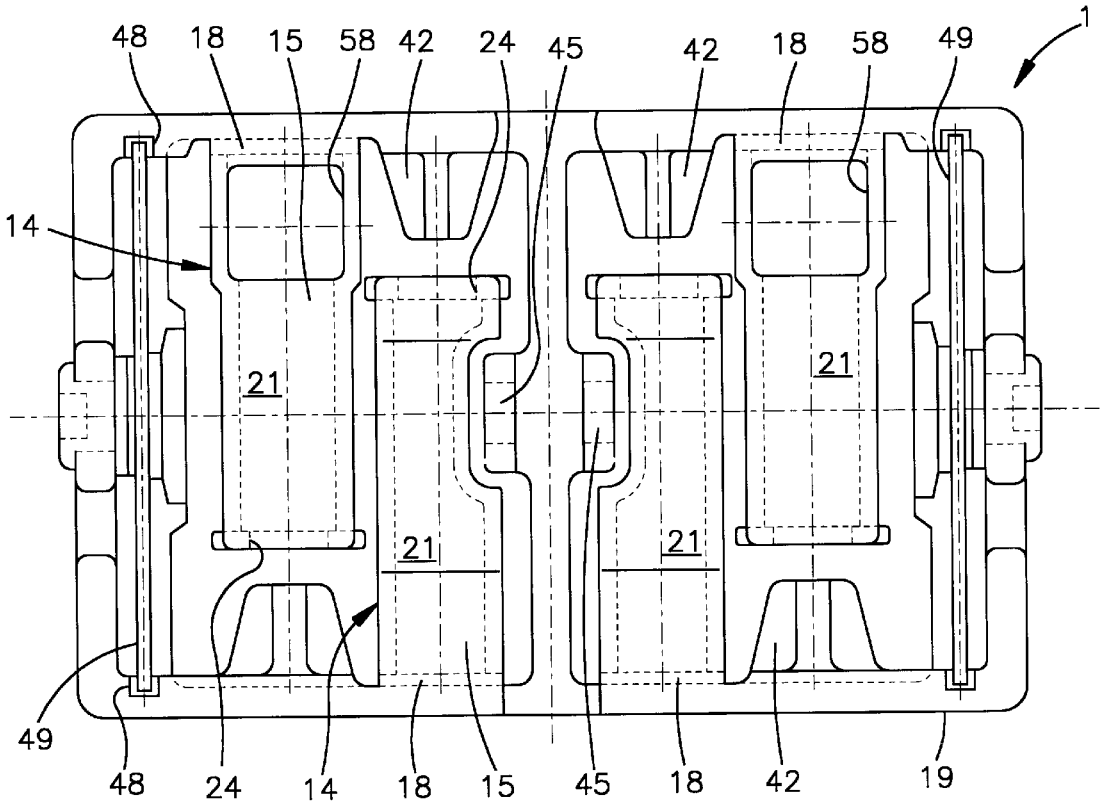
FIG. 7 a view of the rocker switch block in accordance with FIG. 1 along the VII—VII line without actuators.
Figure 8:
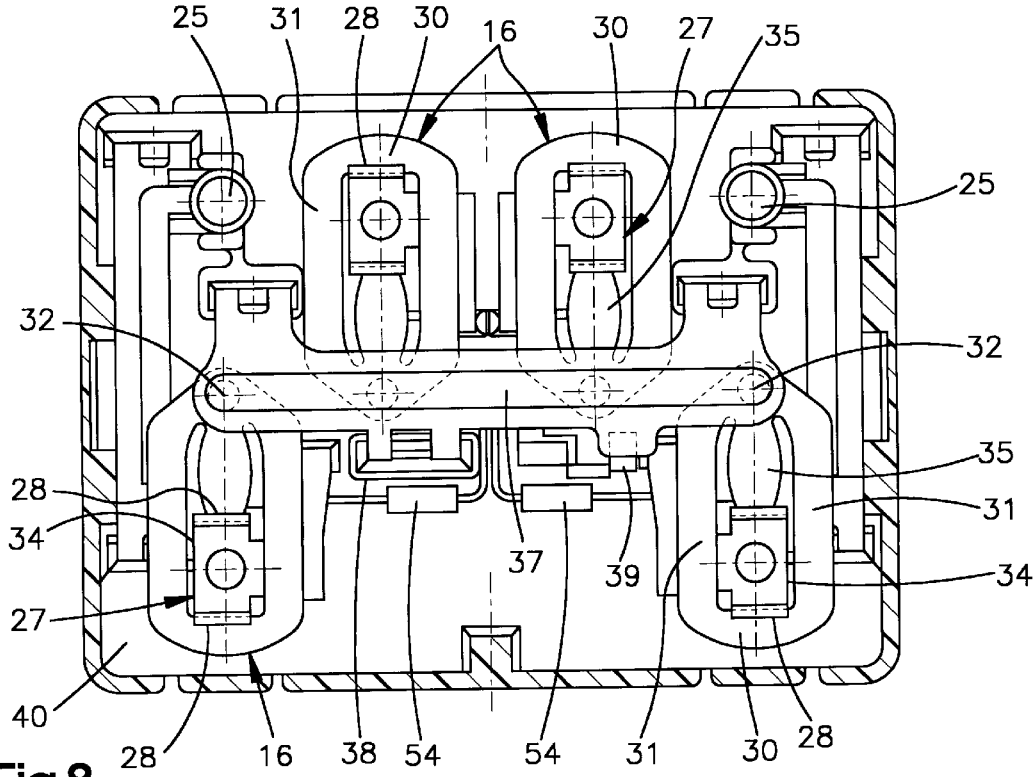
FIG. 8 a view of the rocker switch in accordance with FIG. 1 along the VIII—VIII line.
Figure 9:
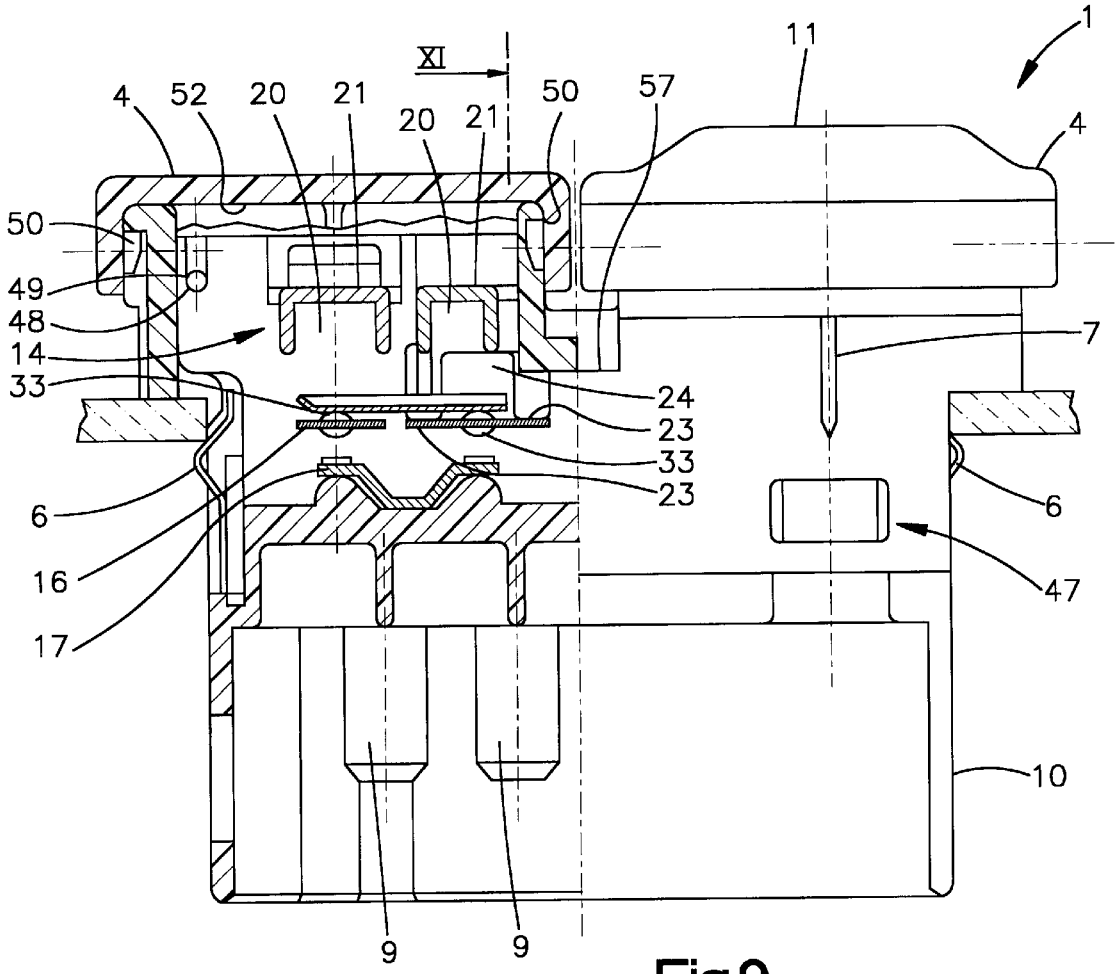
FIG. 9 a half cross-section through the rocker switch in accordance with FIG. 1.
Figure 10:
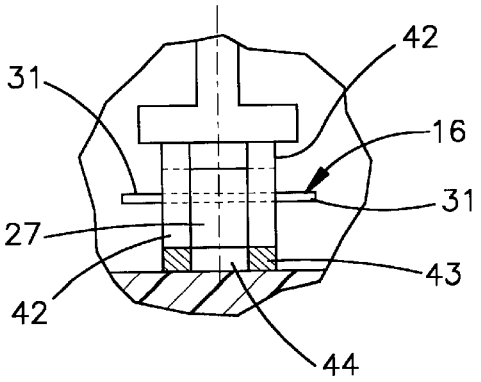
FIG. 10 a part cross-section through the rocker switch in accordance with FIG. 5 in the direction of arrow X; and, FIG. 11 a part cross-section through FIG. 9 in the direction of arrow XI.
Figure 11:
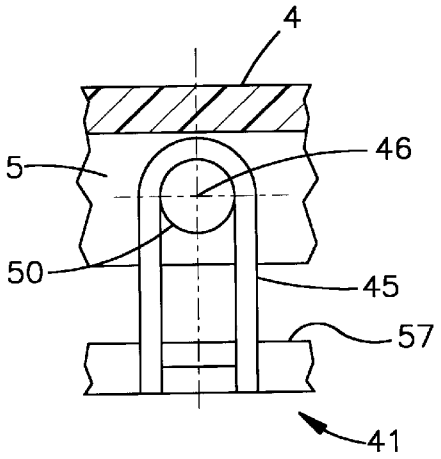

Referring to FIGS. 7 and 8, snap contact 16 is inserted with its frame 30 into the outer notch 29 of contact spring holder 27. Frame 30 has lugs 31 whereby lugs 31 are connected to a contact point 32 in which contact rivet 33 is located. An insertion opening 34 is on the one hand limited by frame 30 and opposite contact point 32 and on the other hand by lugs 31. From contact point 32 a contact spring 35 stretches in the direction of frame 30 which has been made as one piece with snap contact 16. Contact spring holder 27 fits into insertion opening 34 whereby the inner side of frame 30 is inserted into a notch 29 of contact spring holder 27 and the free end of contact spring 35 in opposite notch 29 of contact spring holder 27 so that if actuator 4 is not operated i.e., is in neutral position 22, snap contact 16 reaches upper rest position 36 nearer to actuator 4.

Referring to FIGS. 5–8, upper rest position 36 is provided by a rail 37 which is held in towers 38 by means of a solid connection. At the same time the height is ensured by spacers 39 which are molded on rigid switch part 19. Rail 37 also has a connection contact 9.

Housing 3 of switch block 1 and rocker switch 2 is simultaneously rigid switch part 19 which consists of a base 40 and a wall 41. Supports 42 are molded on wall 41 which fix contact elements 26 in position on base 40 whereby fixing holes 43 are drilled in contact element 26 in which bolts 44 of base 40 are inserted. Cheeks 45 with bearings 46 on wall 41 hold actuator 4 to prevent it from turning.

Base 40 and wall 41 are held together by means of a resilient snap-locking tab and lug connection 47. As can be seen from FIG. 7 support bearings 48 are held in wall 40 of rigid switch part 19 with a spring loaded rod 49 inserted in them.

Bearing pins 50 on actuator 4 click into bearings 46 in cheeks 45 which are molded on wall 41. Pressure plates 51 on inner side 52 of actuator 4 work in conjunction with switch unit 14 whereby pressure plates 51 are molded on actuator 4.

FIG. 6 shows a rocker switch which has been brought from its neutral position 22 into its switch position 53 by moving actuator 4. In this case actuator 4 with its bearing pin 50 in bearing 46 of cheeks 45 swings against the spring force of snap contact 16 and spring rod 19. Pressure plate 51 which is opposite elevated portion 11 presses switch unit 14 via its middle section 21 around foil hinge 18 in an anti-clockwise direction. Switch hump 23 whose release 24 overlaps contact spring 35 presses on lugs 31 of snap contact 16. The pre-tension of snap contact 16 changes and contact rivet 33 moves suddenly from upper rest position 36 of rail 37 to lower contact point 55. After actuator 4 is released this returns again to its neutral position 22 due to the pressure spring force of snap contact 16 and spring-loaded rod 49. After the snap point of snap contact 16 is exceeded, contact rivet 33 again assumes its upper rest position 36 on rail 37.

Contact elements 26 are designed as embossed grids which are arranged at different levels. The embossed grid is cut through at previously defined points. Electronic components 54 are inserted in dips of base 40 which are connected at their terminals in an electrically conductive way to contact elements 26. Switch position 55 is defined from one of contact elements 26 via an elevation 56 in base 40. Housing 3 has a dip 57 in the middle between actuators 4 which represents an upper side of wall 41.

Several rocker switches 2 are connected to a switch block 1. In the example shown switch block 1 consists of two rocker switches 2. Any desired further combination of additional rocker switches 2 is possible.

Although the present invention has been described hereinabove with respect to the illustrated embodiments, it will be understood that the invention is capable of modification and variation and is limited only by the scope of the following claims.

I claim:

1. A rocker actuated switch assembly comprising:

(a) housing means including a base having at least one stationary contact member and a moveable contact member, said moveable contact member moveable with a snap action for opening and closing against said stationary contact;

(b) a rocker actuator mounted for pivotal movement on said housing;

(c) lever means comprising a cantilevered swing lever integrally formed with said housing means, said swing lever being contacted by said rocker member in response to said pivotal movement and operable for having the free end thereof effecting movement of said moveable contact member.

2. The assembly defined in claim 1, wherein said rocker actuator includes a lens, said housing includes a source of illumination and said swing lever has an aperture therein through which said lens is illuminated by said source.

3. The assembly defined in claim 1, wherein said rocker contacts said swing lever intermediate the ends thereof.

* * * * *